US007201285B2

(12) United States Patent
Beggins

(10) Patent No.: US 7,201,285 B2
(45) Date of Patent: Apr. 10, 2007

(54) DUAL FUNCTION INSULATING HOLDER FOR BOTTLE OR CAN

(75) Inventor: Tom Beggins, San Juan Capistrano, CA (US)

(73) Assignee: Wallis H. Wallis Trust of 2004, San Juan Capistrano, CA (US)

( * ) Notice: Subject to any disclaimer, the term of this patent is extended or adjusted under 35 U.S.C. 154(b) by 443 days.

(21) Appl. No.: 10/791,087

(22) Filed: Mar. 2, 2004

(65) Prior Publication Data

US 2005/0194345 A1 Sep. 8, 2005

(51) Int. Cl.
*B65D 23/08* (2006.01)
*B65D 23/10* (2006.01)

(52) U.S. Cl. ..... 215/386; 215/393; 215/396; 220/737; 220/902; 220/903

(58) Field of Classification Search ..... 215/10, 215/12.1, 13.1, 386, 397, 393; 220/8, 592, 220/17, 737, 739, 741, 915.1, 902, 903
See application file for complete search history.

(56) References Cited

U.S. PATENT DOCUMENTS 2,115,654 A * 4/1938 Swofford ..... 215/12.1
2,576,725 A * 11/1951 Schoelies ..... 215/10
3,076,575 A * 2/1963 Leslie-Smith ..... 215/12.1
3,090,478 A * 5/1963 Stanley ..... 248/128
3,120,319 A * 2/1964 Buddrus ..... 215/12.2
3,494,499 A * 2/1970 Kramer et al. ..... 220/8
3,627,161 A * 12/1971 Wergeland ..... 215/11.6
3,779,298 A * 12/1973 Piccirilli et al. ..... 220/4.21
3,918,920 A * 11/1975 Barber ..... 422/104
3,979,011 A * 9/1976 Schleicher ..... 220/742
4,300,612 A * 11/1981 Schroeder et al. ..... 206/521
4,456,134 A * 6/1984 Cooper ..... 215/341
4,487,327 A * 12/1984 Grayson ..... 220/8
4,510,769 A * 4/1985 McClellan, Jr. ..... 62/457.8
4,811,858 A * 3/1989 Augur ..... 215/13.1
4,823,974 A * 4/1989 Crosser ..... 62/457.3
4,823,975 A * 4/1989 Schwankl ..... 220/740
5,375,898 A * 12/1994 Ohmori et al. ..... 294/88
5,390,804 A 2/1995 Beggins
5,580,343 A * 12/1996 Cafiero ..... 482/139
5,829,591 A * 11/1998 Lyons ..... 206/373
5,904,267 A * 5/1999 Thompson ..... 220/592.16
6,123,220 A * 9/2000 Williams ..... 220/737
6,311,865 B1 * 11/2001 Laurent ..... 220/739
6,398,061 B2 * 6/2002 Duff et al. ..... 220/592.16
6,484,897 B1 * 11/2002 Crawley ..... 215/307
6,554,155 B1 4/2003 Beggins
6,604,649 B1 * 8/2003 Campi ..... 220/739

FOREIGN PATENT DOCUMENTS

EP 0162690 A1 * 5/1986
GB 2240332 A * 7/1991

* cited by examiner

*Primary Examiner*—Sue A. Weaver

(57) ABSTRACT

An insulating holder for holding a beverage in a bottle or a can having a lower cylindrical enclosure which receives an upper enclosure having a dome-shaped upper end. The upper and lower enclosures are provided with mating threads or other mating devices to hold the upper and lower enclosures in place when enjoyed. The upper enclosure is adapted to cover the top portion of a bottle inserted into the lower enclosure and to snuggly receive a can when inverted and inserted into the lower enclosure.

20 Claims, 4 Drawing Sheets

DUAL FUNCTION INSULATING HOLDER FOR BOTTLE OR CAN

BACKGROUND OF THE INVENTION

1. Field of the Invention

The present invention relates to improvements in holders for maintaining cold containerized liquids in a cool state and more particularly pertains to a new and improved lightweight portable holder for either a bottle or a can.

2. Description of Related Art

A number of structures for insulating containers have been proposed in the prior art. Perhaps the most familiar structure is the cylindrical foam jacket or sleeve conventionally used to cool standard cylindrical cans containing beer, soda and the like. Such devices are typically inadequate and only partially effective when it comes to a bottle. Other structures exhibit practical drawbacks in that they leave the bottle contents partially exposed or employ cumbersome attachment mechanisms such as mechanical clasps or snaps.

Applicant's U.S. Pat. No. 5,390,804 discloses a bottle insulating device having a lower cylindrical enclosure which telescopically receives an upper enclosure having a dome-shaped upper end and an opening therein of a diameter selected to determine the extent to which the upper enclosure slides down the bottle neck and, hence, the extent to which the upper enclosure extends into the lower enclosure.

Applicant's U.S. Pat. No. 6,554,155 discloses an insulating device for bottles having a lower cylindrical enclosure which telescopically receives an upper enclosure having a dome-shaped upper end, the upper and lower enclosures being provided with mating threads adapted to achieve a plunge insertion and sealing feature.

While these structures exhibit advantages over other prior art cooler devices, it has become apparent to applicant that further improvements could provide even a more useful and effective cooler apparatus, especially in the provision of a single apparatus that can accommodate both a bottle and a can.

SUMMARY OF THE INVENTION

An insulating holder having a lower cylindrical enclosure receives an upper cylindrical enclosure which has a dome-shaped upper end. The upper and lower enclosures fit together by the upper enclosure sliding into the lower enclosure. When the upper enclosure is inserted into the lower enclosure with the dome-shaped upper end on top, the insulating holder accommodates a variety of different sizes of beverage bottles. When the upper enclosure is inserted into the lower enclosure with the dome-shaped end, the insulating holder accommodates a variety of different sized beverage cans inserted into the upper enclosure.

BRIEF DESCRIPTION OF THE DRAWINGS

The exact nature of the present invention, as well as its objects and advantages, will become readily apparent upon consideration of the following detailed description in conjunction with the accompanying drawings in which like reference numerals designate like parts throughout the figures thereof and wherein.

DETAILED DESCRIPTION OF THE PREFERRED EMBODIMENTS

Figure 1:
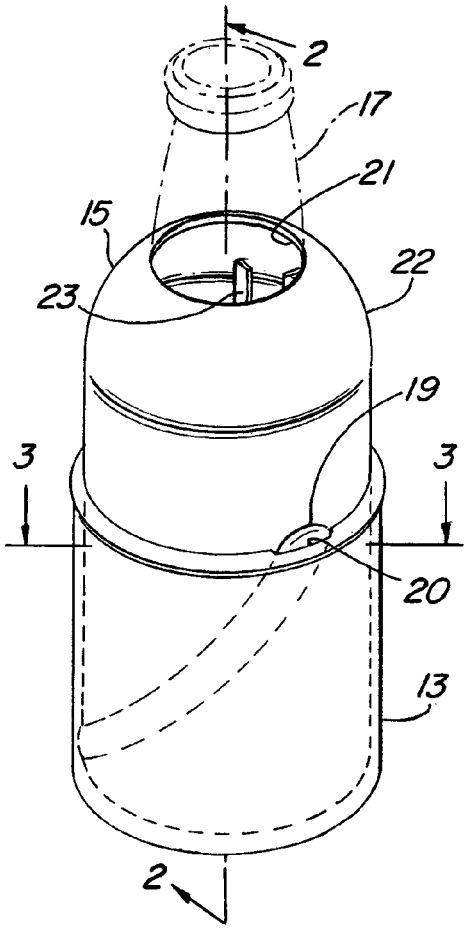
FIG. 1 is a perspective view of a preferred embodiment of the invention.

FIG. 1 illustrates an insulating holder of a first preferred embodiment, which includes a lower cylindrical enclosure 13 and an upper cylindrical enclosure 15. Both the upper enclosure 15 and the lower enclosure 13 are preferably formed out of a relatively rigid insulating material such as, for example, Styrofoam, which provides structural integrity as well as insulating properties. Both the upper enclosure 15 and lower enclosure 13 are shown installed about a bottle 17 (in phantom). The bottle 17 is generally formed to have a side and a neck, which neck generally increases in diameter from the top capped part to a shoulder area (not shown). The general construction of the upper and lower enclosures 15 and 13, respectively, are more completely described in applicant's U.S. Pat. Nos. 5,390,804 and 6,554,155, the disclosures of which are both incorporated herein by reference.

The upper enclosure 15 has dome-shaped top 22. It is inserted into the lower cylindrical-shaped enclosure 13. This insertion is guided and assisted by a male/female thread arrangement 19/20 formed on the inside of the lower cylindrical enclosure and on the exterior surface of the upper cylindrical enclosure 15. Upper cylindrical enclosure 15 has a circular aperture 21 in the symmetrical center of its domed top 22, which is shaped to rest on the shoulder of a bottle 17 being held by the apparatus.

Figure 2:
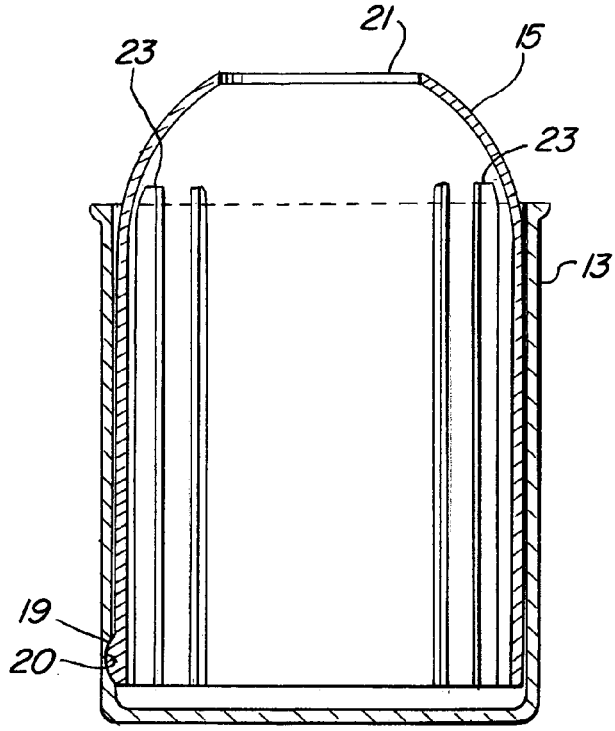
FIG. 2 is a cross-sectional view of FIG. 1 taken along line 2—2.
Figure 3:
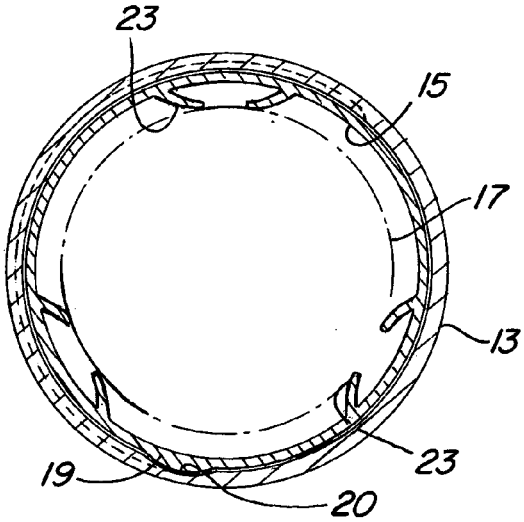
FIG. 3 is a cross-sectional view of FIG. 1 taken along line 3—3.

As is shown in FIG. 2, a plurality of shims 23 are located on the interior surface of the upper cylindrical enclosure. As more clearly shown in FIG. 3, the shims 23 are integral with the interior surface of upper enclosure 15. Each shim is constructed in the form of an open blister. The dimensions of upper enclosure 15 and the shims 23 therein are such that a variety of bottle sizes can be accommodated by the upper enclosure 15 when it inserts into the lower enclosure 13.

Figure 9:
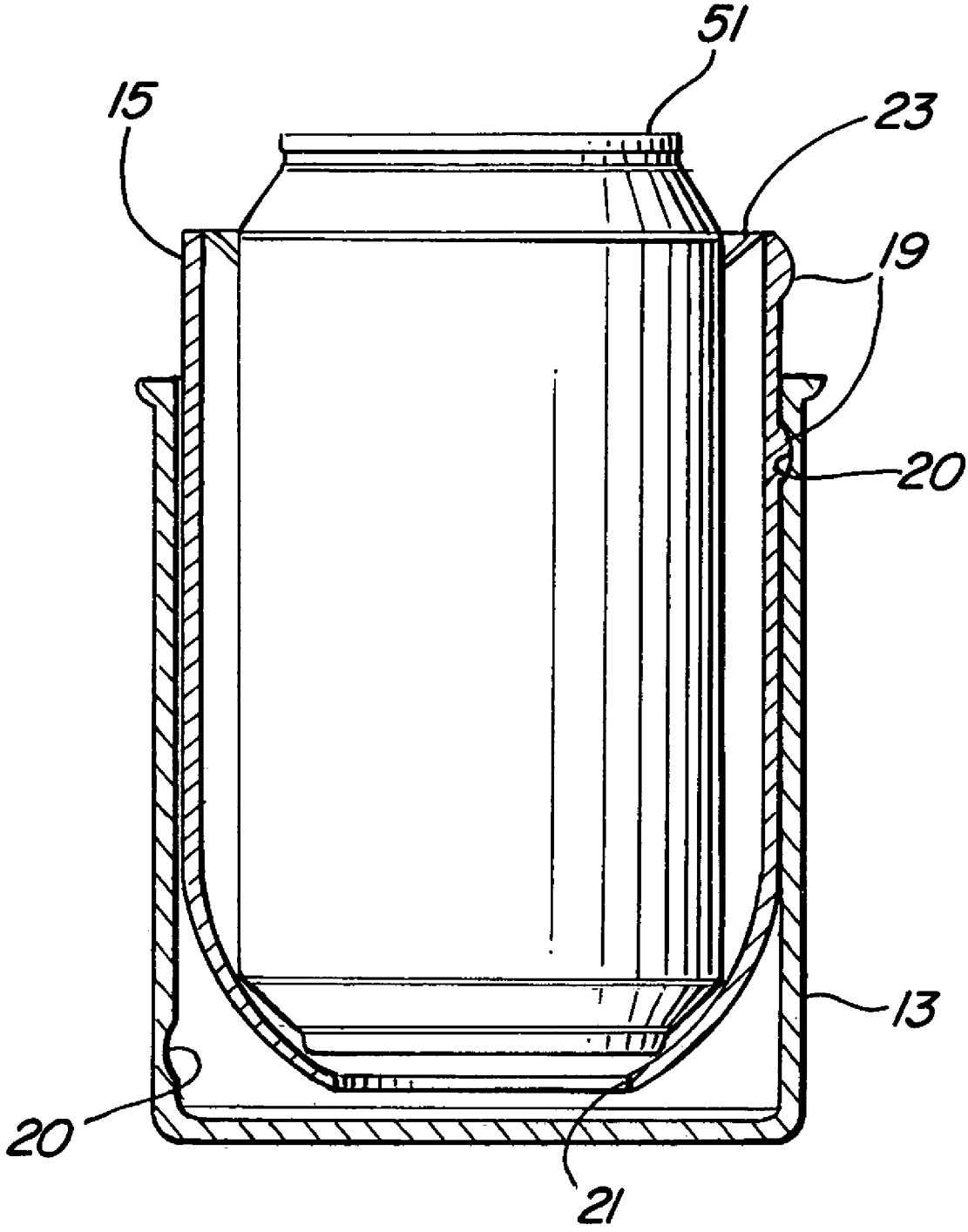
FIG. 9 is a cross-sectional view of the upper and lower enclosures engaged to hold a can, the upper enclosure being reversed from that shown in FIG. 2.

The first thread means 20 located on the inside of the lower cylindrical enclosure 13 and the second thread means 19 formed on the lower portion of the exterior surface of the upper cylindrical enclosure 15 are constructed so that the upper enclosure 15 can be inserted into the lower cylindrical enclosure 13 with the second circular rim end of the upper enclosure 15 going into the lower cylindrical enclosure 13 first, as shown in FIG. 1, or with the first dome-shaped end of the upper enclosure 15 going into the lower cylindrical enclosure 13 first, as shown in FIG. 9.

With the first dome-shaped end of upper enclosure 15 being inserted into the lower enclosure 13, as shown in FIG. 9, a canned beverage container 51 may be firmly held within the interior of the upper cylindrical enclosure by the shims 23 which extend from the circular rim second end of enclosure 15 to the start of the dome-shaped first end of enclosure 15, as more clearly shown in FIG. 2.

By this construction, the insulating holder of the present invention, as illustrated in FIGS. 1, 2, 3 and 9, can be used to hold the bottle 17 by having the upper cylindrical enclosure inserted into the lower cylindrical enclosure in one direction and hold a can 51 by reversing the direction of insertion of the upper cylindrical enclosure into the lower cylindrical enclosure.

Other means of retaining the upper enclosure 15 and the lower enclosure 13, other than the first and second thread means illustrated in FIGS. 1, 2, 3 and 9, may be utilized to advantage in the present invention.

Figure 4:
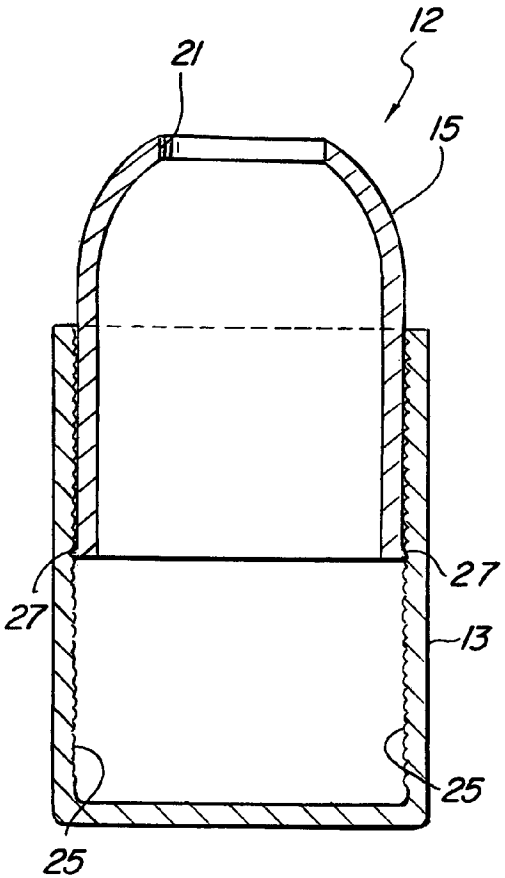
FIG. 4 is a cross-sectional view of an alternate embodiment of the present invention taken along a line 2—2.

FIG. 4 illustrates an alternate preferred structure 12 for engagement between the upper enclosure 15 and the lower enclosure 13. The structure is a plurality of circumferential grooves, a first series of circumferential grooves 25 located on the inside of the lower cylindrical enclosure 13. A circumferential ridge 27 located at the second circular rim of the upper enclosure 15 is adapted to engage with the circumferential grooves 25 and hold the upper enclosure 15 in place, once inserted into lower enclosure 13.

Figure 5:
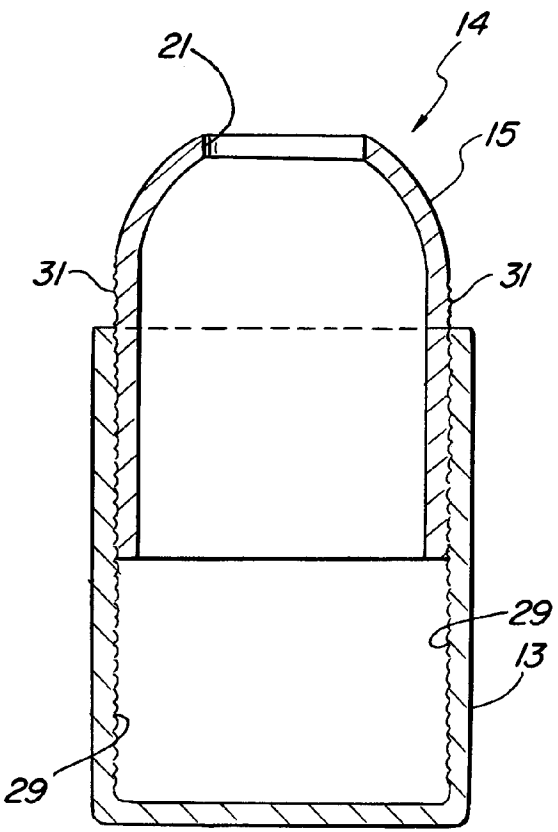
FIG. 5 is a cross-sectional view of another alternate embodiment of the present invention taken along a line 2—2.

Another alternate embodiment 14 illustrated in FIG. 5 utilizes a first series of circumferential grooves 29 on the inside of lower enclosure 13 and a second series of circumferential grooves 31 on the lower portion of the exterior surface of the upper enclosure 15. The first series of circumferential grooves 29 on the inside of the lower cylindrical enclosure 13 and the second series of circumferential grooves 31 on the outside of upper enclosure 15, which may start at the circular rim second end and extend as far as the start of the domed portion of upper enclosure 15, engage each other to hold the upper enclosure 15 within lower enclosure 13.

Figure 6:
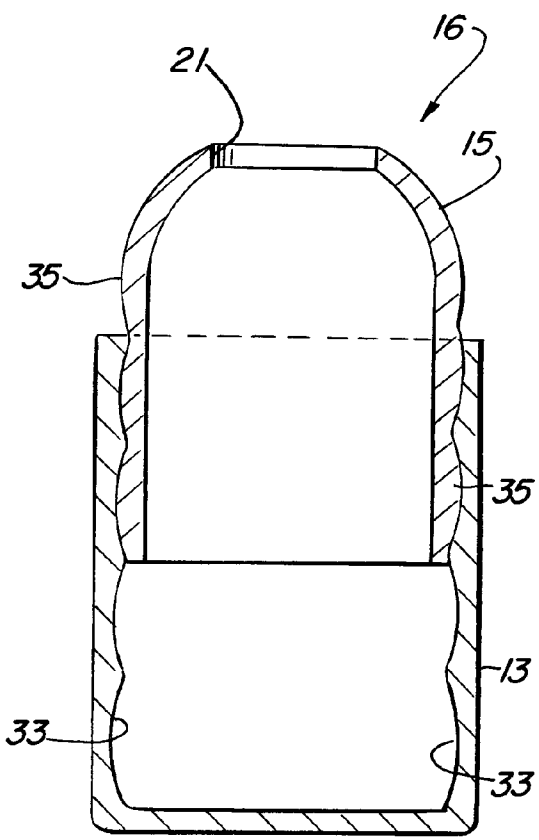
FIG. 6 is a cross-sectional view of yet another alternate embodiment of the present invention taken along a line 2—2.

Another alternate embodiment 16 illustrated in FIG. 6 utilizes a first series of circumferential undulations 33 on the inside of the lower cylindrical enclosure 13. A second series of circumferential undulations 35 are located on the lower portion of the exterior surface of upper enclosure 15, preferably extending from the circular rim second end of upper enclosure 15 close to the start of the domed-shaped first end of upper enclosure 15.

Figure 7:
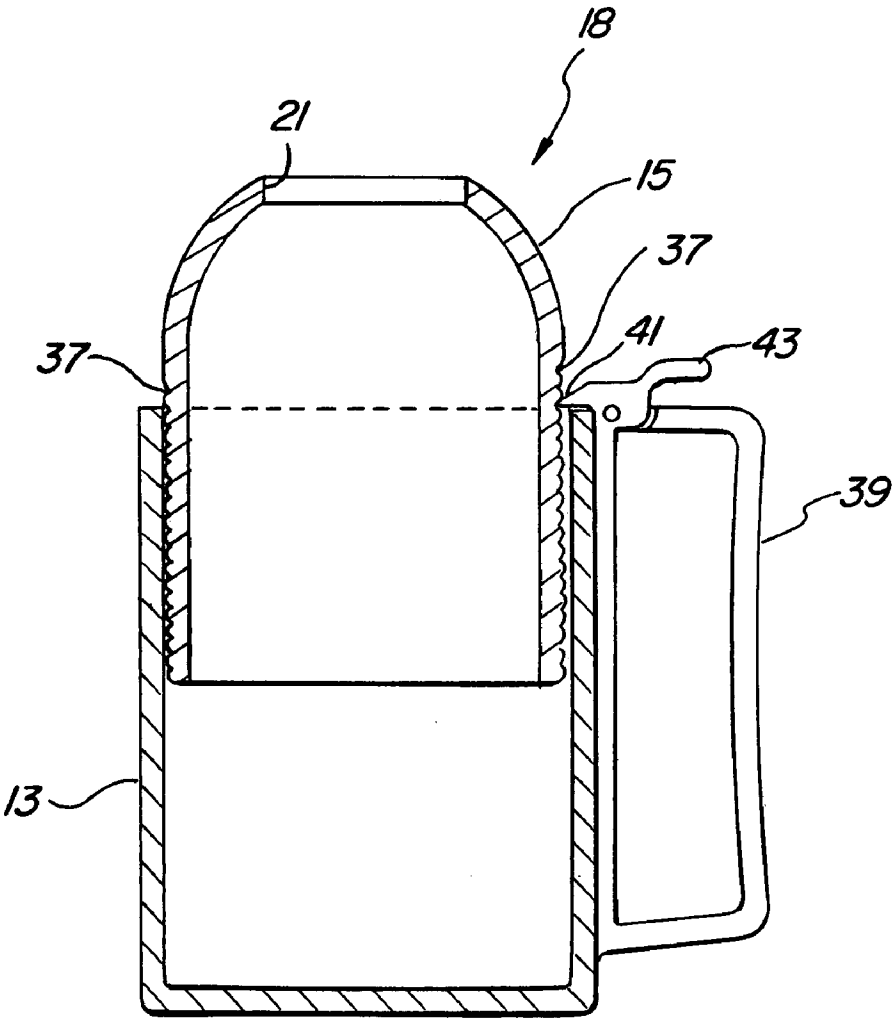
FIG. 7 is a cross-sectional view of yet another embodiment taken along a line 2—2.

Yet another embodiment 18 is illustrated in FIG. 7. This embodiment utilizes a handle 39 mounted to the outside surface of the lower enclosure 13 by an adhesive 45, for example. Handle 39 has a latch 43 which pivots with respect to handle 39 so that the engagement edge 41 of latch 43 makes contact with a series of circumferential grooves 37 formed on the lower portion of the exterior surface of upper enclosure 15 when upper enclosure 15 is inserted into lower enclosure 13. The latch 43, by way of its engaging edge 41, maintains upper enclosure 15 within lower enclosure 13.

Figure 8:
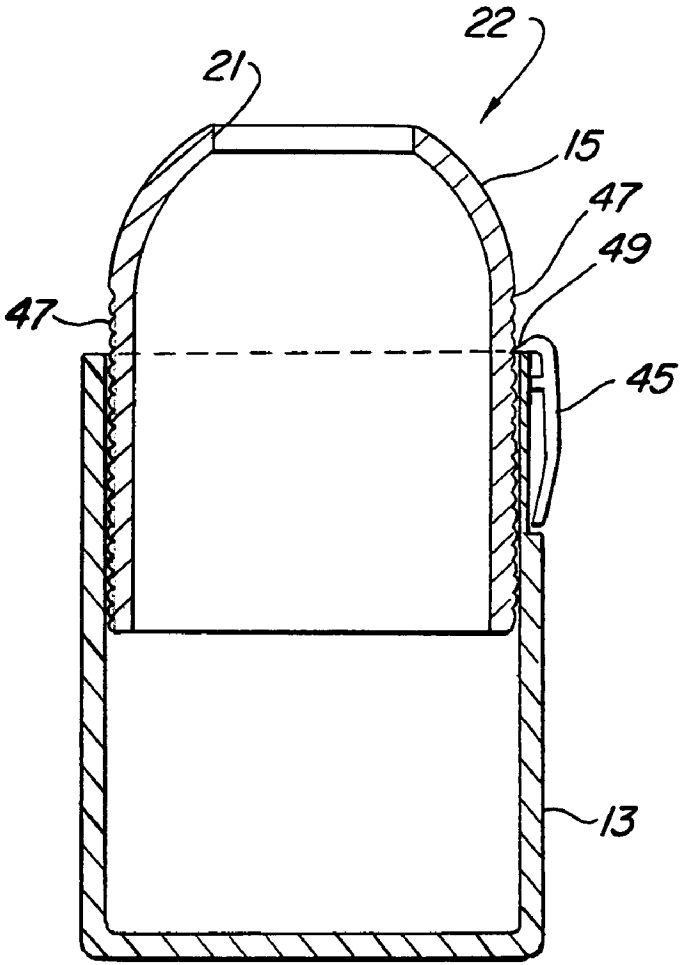
FIG. 8 is a cross-sectional view of yet another embodiment of the present invention taken along a line 2—2.

Another alternate embodiment 22 is illustrated in FIG. 8. Here, the lower enclosure 13 has a latch mechanism 45 attached thereto by way of adhesive or other convenient means. Latch mechanism 45 has an engaging edge 49, which engages a series of circumferential grooves 47 formed on the lower portion of the exterior surface of upper enclosure 15. Latch 45 thus maintains upper enclosure 15 within lower enclosure 13 once inserted therein.

The embodiments 13, 14, 16, 18 and 22 described above with respect to FIGS. 4, 5, 6, 7 and 8 are all capable of functioning to hold either a bottle or a can while maintaining the temperature of the beverages contained therein, as described above. When a bottle is to be held by the insulating holder, the upper enclosure 15 is inserted into the lower enclosure 13 over the bottle with the circular rim second end of upper enclosure 15 inserted first. When a can is to be held by the insulating holder, the upper enclosure 15 is inserted into the lower enclosure 13 with the first dome-shaped end of upper enclosure 15 inserted first.

What is claimed is:

1. An insulating holder for a rigid bottle having a top with a neck that increases in diameter down its length, and a bottom, or for a beverage can that is generally cylindrical with a substantially flat top and bottom, the insulating holder comprising:

a lower cylindrical enclosure formed of insulating foam material for thermally insulating the rigid bottle, the lower cylindrical enclosure having a first end and a second end, the first end closed and the second end opening into a cylindrical interior for receiving the bottom of the rigid bottle; and an invertible upper cylindrical enclosure formed of insulating foam thermally insulating the rigid bottle, the upper enclosure having a dome-shaped first end integrally formed into a cylindrical section that terminates in a circular rim at a second end adapted to telescopically fit into the cylindrical interior of the lower cylindrical enclosure;

the first dome-shaped end having a circular opening therein extending into a cylindrical interior, the opening sized to pass the top of the rigid bottle and come into a locking relation with the neck of the rigid bottle somewhere along the neck, the cylindrical section of the upper cylindrical enclosure enclosing at least a portion of the rigid bottle beneath the circular opening; and a shim structure located in the cylindrical section of the upper cylindrical enclosure; the shim structure adapted to grasp the exterior of a cylindrical beverage can pushed through the circular rim and into the cylindrical section;

whereby when the insulating holder is used for holding a beverage can, the upper cylindrical enclosure telescopically fits into the cylindrical interior of the lower cylindrical enclosure with the first dome-shaped end located at the first closed end of the lower cylindrical enclosure.

2. The insulating holder of claim 1 further comprising:

a first thread means located on the inside of said lower cylindrical enclosure; and a second thread means formed on a lower portion of said upper cylindrical enclosure and extending partway up the side of said upper enclosure, said first and second thread means cooperating during insertion of said upper enclosure in said lower enclosure and retaining said upper enclosure located within said lower enclosure, whether the upper enclosure is inserted into the lower enclosure, second end first or first end first.

3. The insulating holder of claim 2 wherein insertion of the upper enclosure into the lower enclosure is accomplished by a relative rotation of the upper enclosure with respect to the lower enclosure.

4. The insulating holder of claim 2 wherein the lower enclosure has a depth sized to receive at least one-fourth of the length of the bottle and wherein the thread means in the lower enclosure begins at the circular second end.

5. The insulating holder of claim 2 wherein the upper and lower enclosures are constructed of a rigid insulating foam material.

6. The insulating holder of claim 1 further comprising:

a first series of circumferential grooves on the inside of said lower cylindrical enclosure; and a second series of circumferential grooves formed on a lower portion of the exterior surface of said upper enclosure and extending partway up the side of said upper enclosure, the first and second series of grooves cooperating to retain said upper enclosure located within said lower enclosure, whether the upper enclosure is inserted into the lower enclosure, second end first or first end first.

7. The insulating holder of claim 6 wherein the lower enclosure has a depth sized to receive at least one-fourth of the length of the bottle and wherein the thread means in the lower enclosure begins at the circular second end.

8. The insulating holder of claim 6 wherein the upper and lower enclosures are constructed of a rigid insulating foam material.

9. The insulating holder of claim 1 further comprising:

a series of circumferential grooves on the inside of said lower cylindrical enclosure; and a circumferential ridge at the second end of the upper enclosure, the series of circumferential grooves and the circumferential ridge cooperating to retain said upper enclosure located with said lower enclosure when the upper enclosure is inserted into the lower enclosure, second end first.

10. The insulating holder of claim 9 wherein the lower enclosure has a depth sized to receive at least one-fourth of the length of the bottle and wherein the thread means in the lower enclosure begins at the circular second end.

11. The insulating holder of claim 9 wherein the upper and lower enclosures are constructed of a rigid insulating foam material.

12. The insulating holder of claim 1 further comprising:

a first series of circumferential undulations on the inside of said lower cylindrical enclosure; and a second series of circumferential undulations formed on a lower portion of the exterior surface of said upper enclosure and extending partway up the side of said upper enclosure, the first and second series of undulations cooperating to retain said upper enclosure with said lower enclosure, whether the upper enclosure is inserted into the lower enclosure, second end first or first end first.

13. The insulating holder of claim 12 wherein the lower enclosure has a depth sized to receive at least one-fourth of the length of the bottle and wherein the thread means in the lower enclosure begins at the circular second end.

14. The insulating holder of claim 12 wherein the upper and lower enclosures are constructed of a rigid insulating foam material.

15. The insulating holder of claim 1 further comprising:

a handle mounted on the outside surface of said lower enclosure;

a pivoting latch attached to the handle for contacting the exterior surface of the upper enclosure when inserted into the lower enclosure; and a series of circumferential grooves formed in a lower portion of the exterior surface of said upper enclosure and extending partway up the side of said upper enclosure, the latch and circumferential grooves cooperating to retain said upper enclosure within said lower enclosure, whether the upper enclosure is inserted into the lower enclosure, second end first or first end first.

16. The insulating holder of claim 15 wherein the lower enclosure has a depth sized to receive at least one-fourth of the length of the bottle and wherein the thread means in the lower enclosure begins at the circular second end.

17. The insulating holder of claim 15 wherein the upper and lower enclosures are constructed of a rigid insulating foam material.

18. The insulating holder of claim 1 further comprising:

a latch attached to outside surface of said lower enclosure for contacting the exterior surface of the upper enclosure when inserted into the lower enclosure; and a series of circumferential grooves formed in a lower portion of the exte said upper enclosure and extending partway up the outside of said upper enclosure, the latch and circumferential grooves cooperating to retain said upper enclosure within said lower enclosure, whether the upper enclosure is inserted into the lower enclosure, second end first or first end first.

19. The insulating holder of claim 18 wherein the lower enclosure has a depth sized to receive at least one-fourth of the length of the bottle and wherein the thread means in the lower enclosure begins at the circular second end.

20. The insulating holder of claim 18 wherein the upper and lower enclosures are constructed of a rigid insulating foam material.

* * * * *